United States Patent [19]

Brauch et al.

[11] Patent Number: 4,553,491

[45] Date of Patent: Nov. 19, 1985

[54] CONTROL MECHANISM IN A SEWING MACHINE FOR PATTERN AND BUTTONHOLE SEWING

[75] Inventors: Robert B. Brauch, Wayne; John Mihovch, Keansburg, both of N.J.

[73] Assignee: The Singer Company, Stamford, Conn.

[21] Appl. No.: 646,890

[22] Filed: Sep. 4, 1984

[51] Int. Cl.[4] ..... D05B 3/02; D05B 3/04

[52] U.S. Cl. ..... 112/465

[58] Field of Search ..... 112/158 A, 158 D, 158 B, 112/158 R

[56] References Cited

U.S. PATENT DOCUMENTS 3,635,179 1/1972 Ueltschi .
4,019,450 4/1977 Adams .
4,184,440 1/1980 Matsumoto ..... 112/158 A
4,380,204 4/1983 Hanyu et al. ..... 112/158 A
4,428,311 1/1984 Sano .

*Primary Examiner*—Peter Nerbun
*Attorney, Agent, or Firm*—William V. Ebs; Robert E. Smith; Edward L. Bell

[57] ABSTRACT

A cam selecting drum which is loosely supported in punched out holes in the frame of a sewing machine is spring biased into stabilized indexed positions to prevent variable stitch formation, and an idler gear which is also loosely supported on said frame for engagement with a gear on said drum as well as a gear on a mode selecting dial is spring biased to provide a loose meshing relationship with the gear on the drum whereby a feeling of placement of the dial becomes evident in indexed positions of the drum.

5 Claims, 3 Drawing Figures

CONTROL MECHANISM IN A SEWING MACHINE FOR PATTERN AND BUTTONHOLE SEWING

DESCRIPTION

BACKGROUND OF THE INVENTION

1. Field of the Invention

The invention relates to mechanism in a sewing machine for controlling pattern and/or buttonhole sewing.

2. Description of the Invention

Sewing machines capable of pattern and/or buttonhole sewing may include a cam selecting drum positionable by a manually operable dial, continuously rotatable pattern and/or buttonhole cams, and cam followers selectively positionable by fingers on the drum against said cams for use in controlling the operation of needle bight and/or feed regulating mechanism. The present invention is directed to an arrangement as described having the cam selecting drum rotatably mounted in punched out rather than carefully machined holes in a supporting frame, the punched out holes being provided to lessen production costs. While the drum may be somewhat loosely supported in the frame because of the imprecise results realized with punching operations, its position is nevertheless stablized in accordance with the invention to prevent variable stitch formation. A feeling of placement is provided for the manually operable drum positioning dial to clearly convey to an operator when movement of the dial has resulted in the attainment of a cam selecting position by the drum.

SUMMARY OF THE INVENTION

A sewing machine according to the invention includes a dial for selecting an operating mode, a gear rotatable by the dial, an idler gear rotatable by the dial rotatable gear, a drum with fingers thereon, a gear on the cam selecting drum in engagement with the idler gear for rotationally positioning the drum in response to operation of the dial, a ratchet wheel on the drum, and a fixed indexing detent spring for the ratchet wheel. The machine further includes continuously rotatable stitch controlling cams, cam followers selectively positionable in response to indexing movements of the cam selecting drum by the fingers thereon against said cams for actuation thereby, and mechanism operably associated with the cam followers for controlling stitch forming instrumentalities on the machine. The cam selecting drum is loosely supported in the machine and is forcibly engaged by a spring biased member which establishes a stabilized location for the drum in the indexed positions thereof. The idler gear is also loosely supported in the machine, and is biased by a spring for a loose meshing relationship with the gear on the cam selecting drum resulting in play in the dial when in mode selecting positions.

DESCRIPTION OF THE PREFERRED EMBODIMENT

Figure 1:
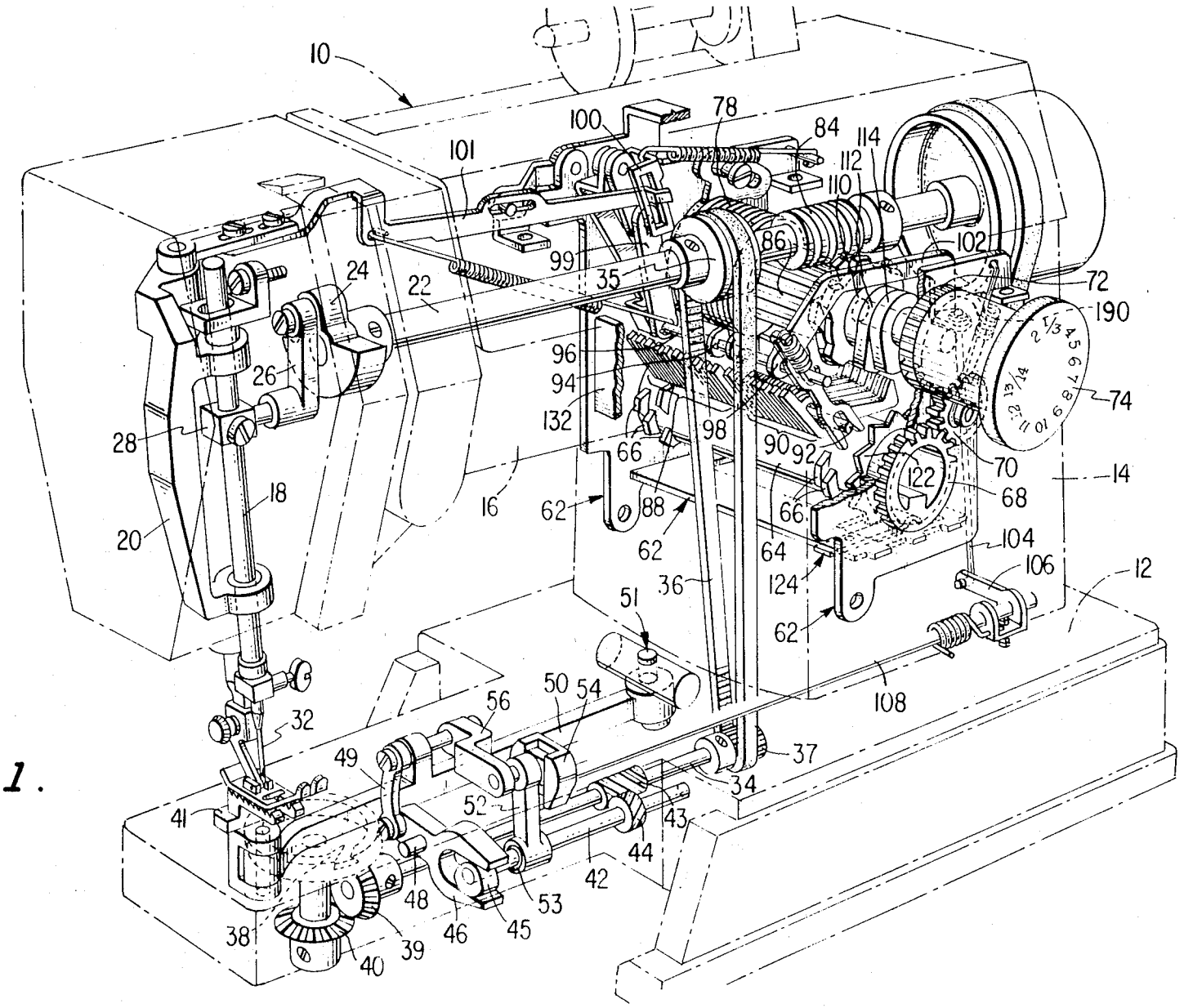
FIG. 1 is a diagrammatic perspective view of a sewing machine according to the invention.
Figure 2:
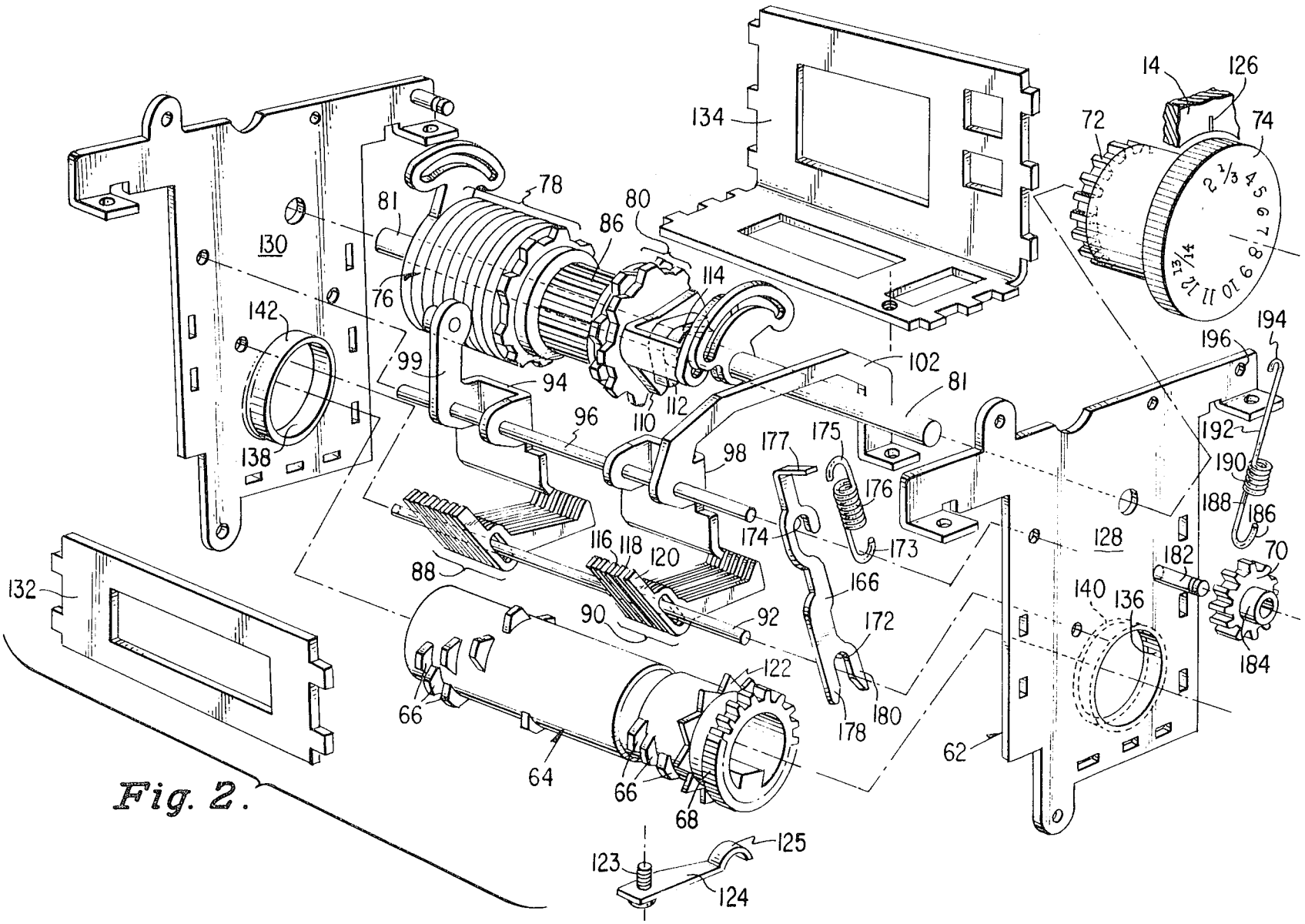
FIG. 2 is an exploaded perspective view of a modular control unit for the machine; and, FIG. 3 is a front elevational view of the modular control unit.
Figure 3:
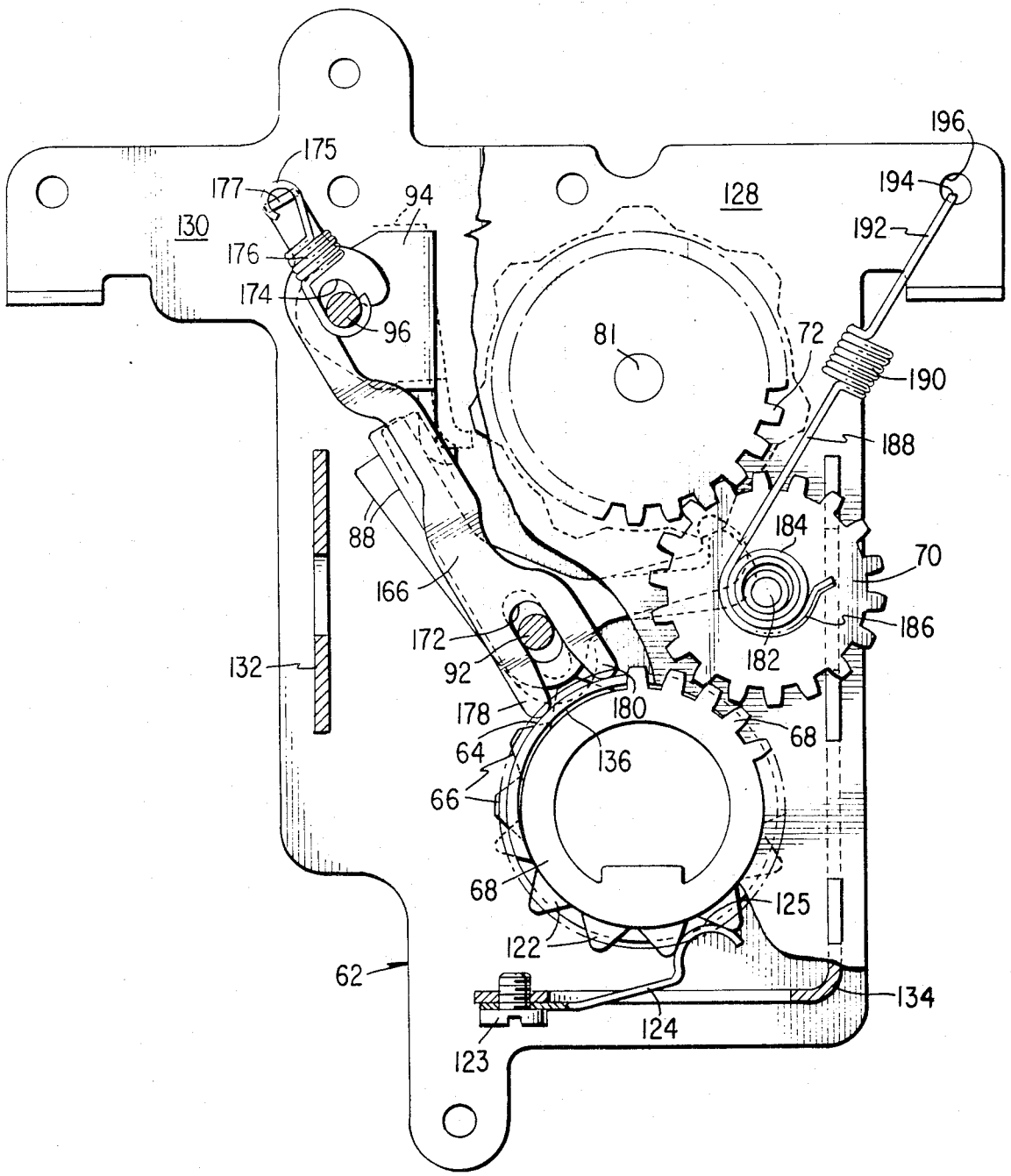

Referring to the drawings, reference character 10 designates a sewing machine including a bed 12, a standard 14 rising from the bed, and a bracket arm 16 overhanging the bed. A needle bar 18 is supported in a gate 20 for endwise reciprocation by an arm shaft 22 acting through a crank 24, drive link 26 and a needle bar attached collar 28. The gate is conventionally mounted in the machine for pivotal movement effective to laterally jog the needle bar 18 and needle 32 affixed therein. A bed shaft 34 is rotatable by the arm shaft 22 acting through a sprocket 35 on the arm shaft, a timing belt 36 and a sprocket 37 on the bed shaft. A looptaker 38 is rotatable in timed relation to endwise reciprocation of needle 32 by the bed shaft acting through gears 39 and 40. The machine includes mechanism of a well known type for imparting work transporting movement to a feed dog 41. Such mechanism includes a feed drive shaft 42 driven by gears 43 and 44 from the bed shaft, a feed lift cam 45 on the feed drive shaft, a lever 46 embracing cam 45 and pivoted at 48 in the bed of the machine, a link 49 connecting lever 46 with a feed bar 50 supported on gimbles 51, a pitman 52 driven by an eccentric 53 on shaft 42 and connected to reciprocate in a slideblock 54, and a link 56 which pivotally connects pitman 52 with feed bar 50. The magnitude and direction of work feeding feed dog movements of feed dog 41 are determined by the inclination of slideblock 54.

Reference character 62 designates the frame of a module wherein mechanism for controlling pattern and buttonhole sewing is located. Such control mechanism includes a cam selecting rotatable drum 64 with radially projecting fingers 66 that are spaced apart from one another both longitudinally and circumferentially on the drum. The drum includes a gear 68 which is engaged by an idler gear 70. The idler gear meshes with a gear 72 which is rotatable by a dial 74. Drum 64 may therefore be rotationally positioned by operation of the dial.

The control mechanism also includes a drum 76 with needle bight controlling cams 78 as well as feed controlling cams 80 thereon. Drum 76 is rotatably supported on a fixed shaft 81 for continuous rotation by arm shaft 22 acting through a worm 84 on the arm shaft and a gear 86 on the drum. Cam followers 88 and 90, pivotally mounted on a fixed shaft 92, are selectively positionable by fingers 66 on cam selecting drum 64 against the needle bight and feed controlling cams 78 and 80, respectively, on drum 76. Cam followers 88 are associated with an actuator 94 pivoted on a fixed shaft 96, and cam followers 90 are associated with an actuator 98 which is also pivoted on shaft 96. Whenever a cam follower is positioned by a finger on selecting drum 64 against a cam on drum 76, such cam follower is also caused to engage its associated actuator 94 or 98, and the actuator is moved by the cam follower according to the profile of the cam during rotation of drum 76. Actuator 94 connects through an arm 99 thereon, a link 100, and a link 101 with needle bar gate 20 to control lateral movement of the needle, whereas actuator 98 connects through links 102, 104 and 106 with a rock shaft 108 to control the movement of slideblock 54 affixed thereon, and thereby work feeding movements of feed dog 41.

The control mechanism further includes frame affixed cams 110, 112 and 114 on shaft 81. Cam followers 116, 118 and 120 pivotally moveable on shaft 92 are selectively positionable against cams 110, 112 and 114, respectively, by fingers 66 on drum 64. Such cam followers are associated with actuator 98 and are used to position the actuator as required to fix the position of the feed dog for barring at opposite ends of a buttonhole, to provide forward feeding for the formation of one side of the buttonhole, and to provide reverse feeding for the formation of the other side of the buttonhole.

A bidirectional ratchet wheel 122 on drum 64, and a detent spring 124 having one end secured by a screw 123 in frame 62 and the other end 125 in engagement with the wheel indexes drum 64 into cam selecting positions corresponding to positions of alignment of indications on the dial with a mark 126 on standard 14. In each of the positions of alignment of dial indications 5 through 10 with mark 126, drum 64 is disposed to select a particular cam 78 for the sewing of a bight controlled pattern defined thereby, whereas in each of the positions of alignment of dial indications 11 through 14 with mark 126, both a particular cam 78 and a particular cam 80 are selected for the sewing of a bight and feed controlled pattern. In aligned positions 1 and 3 of the dial with mark 126, a cam 78 and cam 112 are selected to provide for the formation of barring stitches at opposite ends of a buttonhole. In position 2 another cam 78 and cam 114 are selected to provide for the formation of stitches on one side of the buttonhole with the forward feeding of material under needle 32, and in position 4 the same cam 78 as for position 3 and cam 110 are selected to provide for the formation of stitches on the other side of the buttonhole with the reverse feeding of material under the needle.

Frame 62 wherein the described mechanism for controlling pattern and buttonhole sewing is located includes front and back sheet metal plates 128 and 130, respectively, which are held in an assembled relationship with connecting plates 132 and 134. Drum 64 is rotatably supported at punched out holes 136 and 138 in the front and back plates on flanges 140 and 142 formed in the punching process. Although punched holes are necessarily somewhat imprecise and drum 64 may be only loosely supported therein, a single stablized position for the drum in all of its indexed positions is obtained with a spring biased member 166. Member 166 is slidably mounted at the rear side of plate 128 on shafts 92 and 96 extending into slots 172 and 174 in the member. A spring 176 having one end 173 curled about shaft 96 and the other end 175 curled about an end tab 177 on member 166 biases the member toward drum 64 causing forked spaced apart portions 178 and 180 at the opposite end of the member from tab 177 to forcibly bear against the surface of the drum, and establish a location for the drum in indexed cam selecting positions. Consistency in the stitches in any cam selecting position of drum 64 is thereby assured.

Idler gear 70 is loosely mounted for rotation on a stub shaft 182 affixed in plate 128, and is engaged at a hub 184 by a hooked end 186 of an extended linear end portion 188 of a coil spring 190. An opposite linear end portion 192 of the spring is hooked at 194 through a hole 196 in plate 128. Spring 190 biases idler gear 70 in a direction away from gear 68 to provide a loose meshing relationship with gear 68. Such loose meshing relationship between gears 68 and 70 results in some circumferential play in dial 74 in the cam selecting indexed positions of drum 64, and so provides a feeling of placement to an operator of the dial, indicating when movement of the dial has resulted in the attainment of a cam selecting position by drum 64.

It is to be understood that the present disclosure relates to a preferred embodiment of the invention which is for purposes of illustration only, and is not to be construed as limiting the invention. Numerous alterations and modifications of the structure herein will suggest themselves to those skilled in the art, and all such modifications and alterations which do not depart from the spirit and scope of the invention are intended to be included within the scope of the appended claims.

We claim:

1. In a sewing machine, a dial for selecting an operating mode, a gear rotatable by said dial, an idler gear rotatable by the dial rotatable gear, a cam selecting rotatable drum with fingers thereon, a gear on the cam selecting drum in engagement with the idler gear for rotationally positioning said drum in response to operation of the dial, a ratchet wheel on the drum, a fixed indexing detent spring for the ratchet wheel, a continuously rotatable drum with stitch controlling cams thereon, cam followers selectively positionable, in response to indexed movements of the cam selecting drum by the fingers thereon, against said cams for actuation thereby, and mechanism operably associated with the cam followers for controlling stitch forming instrumentalities on the machine, said cam selecting drum being loosely supported in the machine and being forcibly engaged by a spring biased member to establish a stabilized location for the drum in the indexed positions thereof, the idler gear also being loosely supported on the machine and being biased by a spring for a loose meshing relationship with the gear on the cam selecting drum resulting in play in said dial when in mode selecting positions.

2. The combination of claim 1 wherein the spring which biases the idler gear has one end affixed in the machine and the opposite end extending about a hub on the idler gear.

3. The combination of claim 1 wherein the spring biased member is slidably mounted in the machine and bears at one end against the cam selecting drum.

4. The combination of claim 1 wherein the idler gear biasing spring is a coil spring with extended linear end portions one of which connects with a fixed frame in the machine and the other of which is connected to a hub on the idler gear.

5. The combination of claim 1 wherein the spring biased member engages the drum at spaced apart locations.

* * * * *